US006299353B1

(12) United States Patent
Piechocki et al.

(10) Patent No.: US 6,299,353 B1
(45) Date of Patent: Oct. 9, 2001

(54) ZIPPER FOR RECLOSABLE CONTAINER WITH APERTURES PASSING THROUGH FEMALE PROFILE

(75) Inventors: Duane B. Piechocki, Pleasantville; Zdenek Machacek, Nanuet, both of NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/535,771

(22) Filed: Mar. 28, 2000

(51) Int. Cl.[7] ..... B65D 33/16
(52) U.S. Cl. ..... 383/63; 24/587; 24/324
(58) Field of Search ..... 24/587, 324; 383/63

(56) References Cited

U.S. PATENT DOCUMENTS

| | | | | |
|---|---|---|---|---|
| Re. 34,554 | * | 3/1994 | Ausnit | 353/63 |
| 4,532,652 | * | 7/1985 | Herrington | 383/63 X |
| 4,817,188 | * | 3/1989 | Van Erden | 24/587 X |
| 4,964,739 | * | 10/1990 | Branson et al. | 383/63 X |
| 5,017,021 | * | 5/1991 | Simonsen et al. | 383/63 |
| 5,273,511 | | 12/1993 | Boeckman . | |
| 5,363,540 | * | 11/1994 | Ddais et al. | 24/587 |
| 5,403,094 | * | 4/1995 | Tomic | 383/63 |
| 5,617,770 | | 4/1997 | May . | |
| 5,829,884 | * | 11/1998 | Yeager | 383/63 X |
| 5,878,468 | | 3/1999 | Tomic et al. . | |
| 5,901,625 | * | 5/1999 | May | 83/338 |
| 5,934,806 | * | 8/1999 | Tomic et al. | 383/63 |
| 6,152,600 | * | 11/2000 | Tomic | 383/63 |

FOREIGN PATENT DOCUMENTS

| | | | | |
|---|---|---|---|---|
| 398732 | * | 11/1990 | (EP) | 24/587 |

* cited by examiner

*Primary Examiner*—Allan N. Shoap
*Assistant Examiner*—Robin A. Hylton
(74) *Attorney, Agent, or Firm*—Pitney, Hardin, Kipp & Szuch LLP

(57) ABSTRACT

The zipper for a reclosable bag includes a male profile and a female profile. The female profile includes first and second legs extending from a planar base, with a space formed therebetween for insertion of a male profile therein. Apertures are formed in the planar base providing communication between the space between the first and second legs and an opposite side of the planar base. This allows the insertion of the male profile into the female element to urge particles or powder lodged in the space to pass through the apertures to the opposite side of the planar base.

23 Claims, 3 Drawing Sheets

ZIPPER FOR RECLOSABLE CONTAINER WITH APERTURES PASSING THROUGH FEMALE PROFILE

BACKGROUND OF THE INVENTION

1. Field of the Invention

This invention pertains to a zipper for a reclosable container, such as a bag manufactured by a form, fill and seal apparatus, wherein the base of the female profile includes apertures which allows packaged product, such as powder, which has entered the female profile, to pass through the apertures and return to being packaged within the reclosable container.

2. Description of the Prior Art

In the prior art, it is known to use a zipper with a female profile and a male profile in the manufacture of a reclosable container, such as a bag manufactured by a form, fill and seal apparatus. However, it is further known that if a fine powder product is packaged within the reclosable container, that this fine powder or similar particles can enter the female profile and degrade the performance of the zipper by blocking insertion of the male profile. Furthermore, if the user cleans this fine powder product from the female profile, this powder tends to be discarded rather than returned to the reclosable package. Moreover, this cleaning of the female profile can tend to contaminate any fine powder product that is returned to the reclosable package.

U.S. Pat. No. 5,878,468 entitled "Closure Arrangement for Reclosable Bag and Method Thereof" and issued to Tomic et al. on Mar. 9, 1999 discloses longitudinal breaks in at least one leg of the female profile. These longitudinal breaks can further occur in both legs of the female profile along with the male profile. However, this can degrade the sealing properties of the zipper. Moreover, this is somewhat inefficient in that the fine powder product must move at a right angle to the direction of insertion of the male profile into the female profile.

A somewhat similar structure and corresponding method are disclosed in U.S. Pat. No. 5,617,770 entitled "Closure Arrangement for Reclosable Bag" issued on Apr. 8, 1997 to May wherein portions are removed from one leg of the female profile by an L-shaped punch.

U.S. Pat. No. 5,273,511 entitled "Method to Improve Welding of Profiled Plastic Film or Tape" and issued to Boeckman on Dec. 28, 1993 discloses longitudinal breaks in the female profile with apertures formed in the film of the container or bag along these longitudinal breaks. Again, this can degrade the sealing properties of the zipper and further requires the precise alignment of the sections of female profile, so that the apertures are positioned in the breaks between these sections.

OBJECTS AND SUMMARY OF THE INVENTION

It is therefore an object of this invention to provide a zipper for a reclosable container which can accommodate fine powder product entering the female profile.

It is therefore a further object of this invention to provide a zipper for a reclosable container which can efficiently return fine powder product from the female profile to the interior of the reclosable container, with a minimum of possibility of contamination of the fine powder product.

It is therefore a still further object of this invention to provide a zipper for a reclosable container which attains the above objects while maintaining the strength and integrity of the closed zipper.

It is therefore a still further object of this invention to provide a zipper for a reclosable container which attains the above objects without significantly increased manufacturing costs.

These and other objects are attained by providing a zipper with a female profile wherein apertures are periodically formed in the base thereof passing into the interior of the reclosable container. When fine powder product becomes lodged within the female profile, the male profile can push the lodged fine powder product through the apertures in the base of the female profile to return to the interior of the reclosable container. As the legs of the female profile, as well as the male profile, remain intact, there is no degradation of the sealing provided by the zipper. Moreover, the direction of travel of the fine powder product through the apertures is substantially the same as the direction of the male profile as it enters the female profile. As the fine powder product can be returned to the interior of the reclosable container without direct contact with the user, the fine powder product tends to be returned to the interior of the reclosable container free of contamination. To prevent powder from entering the female profile through the apertures the female profile material that is cut to form the apertures may be left attached along an edge, thereby forming a flap that can serve as a simple one-way valve to permit powder to be removed from the profile while preventing powder from entering the profile.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
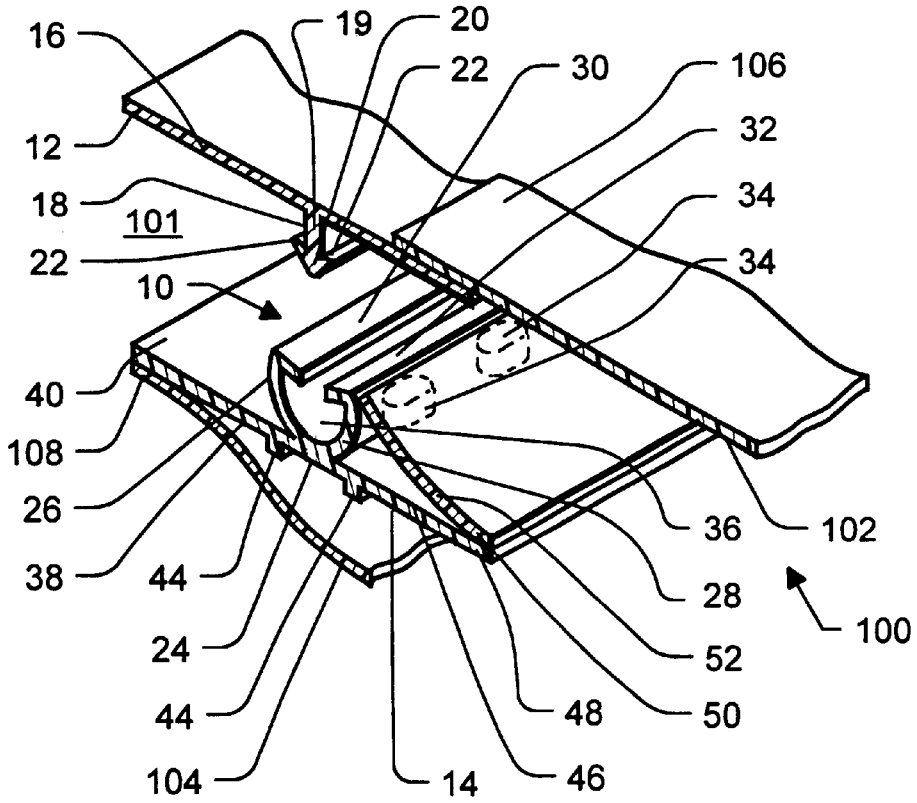
FIG. 1 is a perspective view of the male and female profiles of the zipper of the present invention, with the apertures shown in phantom.
Figure 2:
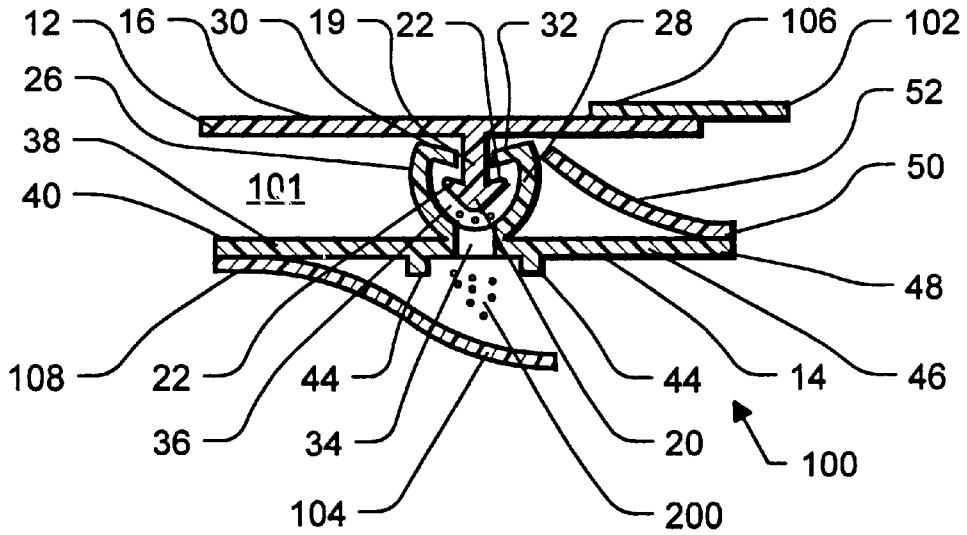
FIG. 2 is a cross-sectional view of the male and female profiles of the zipper of the present invention, showing the fine powder product passing through the apertures from the female profile to the interior of the reclosable container.
Figure 3:
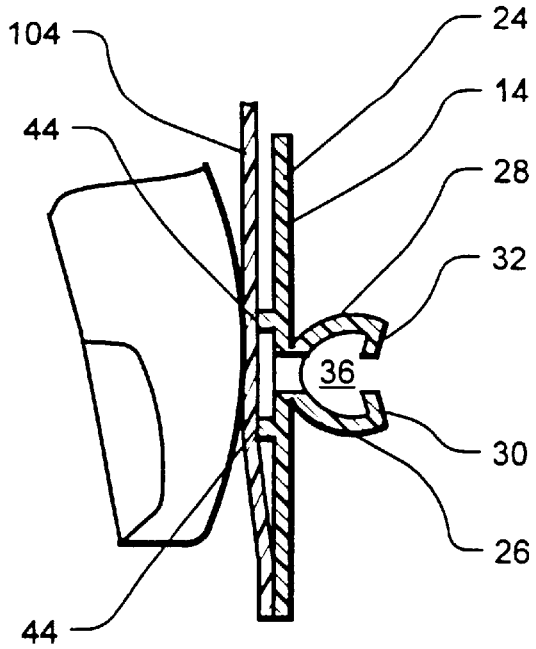
FIG. 3 is a cross-sectional view of the male and female profiles of the zipper of the present invention, illustrating in detail the knobs used to maintain a clearance below the female profile.

Referring now to the drawings in detail wherein like numerals indicate like elements throughout the several views, one sees that FIG. 1 is a perspective view of the zipper 10 as attached to bag 100. Bag 100 is typically formed from an upper film sheet 102 and a lower film sheet 104 (the terms "upper" and "lower" used with respect to the orientation shown in FIG. 1). Upper film sheet 102 and lower film sheet 104 are typically sealed together at three sides, so as to form mouth 101 of the bag 100 at a fourth side. Typically, a form, fill and seal apparatus (not shown) is used to manufacture bag 100. Zipper 10 is used to reclosably seal the mouth 101 formed between upper and lower film sheets 102, 104. Zipper 10 includes male profile 12 and female profile 14. Male profile 12 includes planar base 16 and male element 18 with shaft 19 extending perpendicularly from planar base 16. Shaft 19 terminates with enlarged head 20 with undercut detent surfaces 22 for engaging female profile 14. As shown in FIGS. 1 and 2, a portion of planar base 16 is welded to edge section 106 of upper film sheet 102. Alternatively, as shown in FIG. 4, the entire planar base 16 can be welded to upper film sheet 102.

Female profile 14 includes planar base 24 with first and second legs 26, 28 extending therefrom. Legs 26, 28 terminate in inwardly pointing detent surfaces 30, 32, respectively, for releasably engaging undercut detent surfaces 22 of enlarged head 20 of male profile 12 as shown in FIG. 2. Apertures 34 are formed periodically through planar base 24 thereby providing communication from the space 36 formed between legs 26, 28 to an opposite side of planar base 24. Apertures 34 can be of various shapes such as round, oval, elongated, square, rectangular, etc. Planar base 24 further includes first extension flange 38 on one side thereof which extends away from first and second legs 26, 28 and has distal end 40 which is welded to edge 108 of lower film sheet 104. As the portion of planar base 24 proximate to apertures 34 is not welded to lower film sheet 104, this provides communication from space 36 to the interior of bag 100. Therefore, as shown in FIG. 2, when fine powder product 200 is lodged within space 36 between legs 26, 28 of female profile 14, the subsequent insertion of male element 18 into space 36 between legs 26, 28 urges fine powder product 200 through apertures 34 in planar base 24 and into the interior of bag 100.

Figure 4:
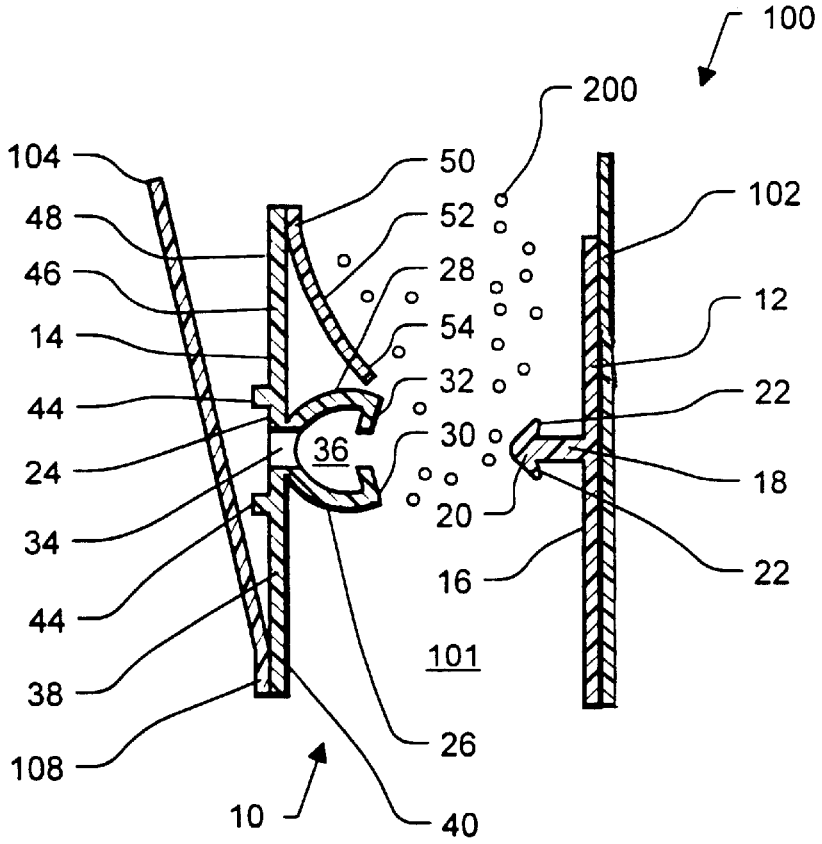
FIG. 4 is a cross-sectional view of the male and female profiles of the zipper of the present invention during dispensing, showing how the deflector minimizes the amount of fine powder product entering the female profile.

As shown in FIGS. 1, 2, and 4, planar base 24 of female profile 14 includes second extension flange 46 which extends inwardly into bag 100. Distal end 48 of second extension flange 46 is welded to proximal end 50 of deflector sheet 52. Alternately, deflector 52 and extension flange 46 may be made of one piece and folded at the desired location. Distal end 54 of deflector sheet 52 abuts second leg 28 of female profile 14 thereby tending to deflect fine powder product 200 away from female profile 14 as fine powder product 200 is being dispensed from bag 100 thereby decreasing the amount of fine powder product 200 which lodges in the space 36 between first and second legs 26, 28 of female profile 14.

Furthermore, as shown in FIGS. 1–4, knobs 44 are formed on planar base 24 and protrude therefrom adjacent to apertures 34 thereby maintaining a space between planar base 24 and lower film sheet 104 and likewise maintaining a communication path between apertures 34 and the interior of bag 100 in the face of the closing pressure exerted against female profile 14.

Figure 5:
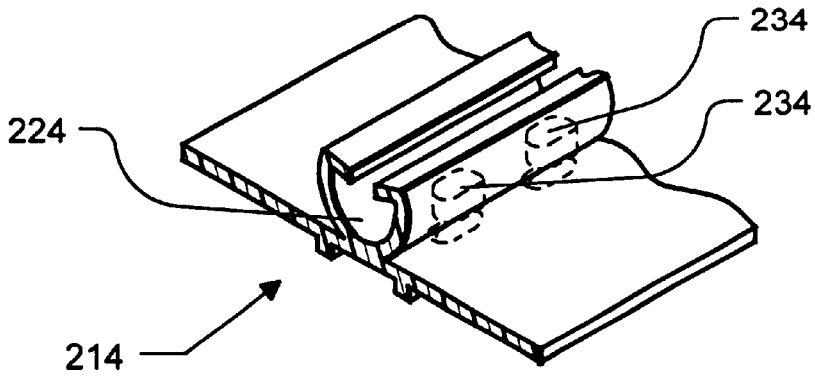
FIG. 5 is a fragmentary perspective view of an alternative construction for the female profile in which the aperture defining material is left attached as a flap.
Figure 6:
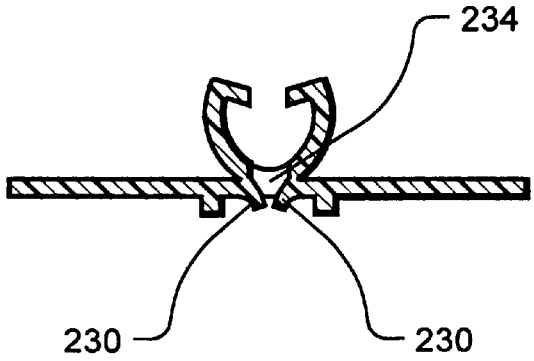
FIG. 6 is a cross-sectional view of a first embodiment of a female profile provided with a flapped aperture.
Figure 7:
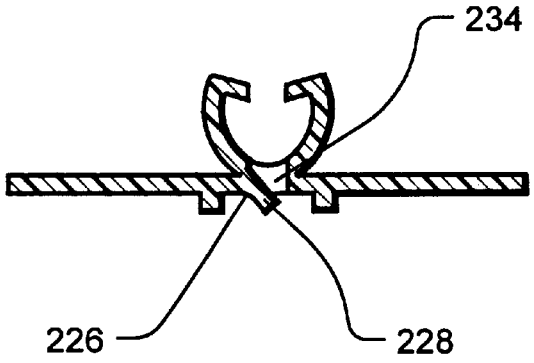
FIG. 7 is a cross-sectional view of a second embodiment of a female profile provided with a flapped aperture.

In FIG. 5 an alternative construction for a female profile 214 is depicted. The engaging portions of the female profile 214 are the same as that for the female profile 14 and hence are not discussed again. In accordance with this construction, the material cut to provide the spaced apart apertures 234 formed in the planar base 224 is not removed. Rather, the material is left attached along an edge 226 providing a flap closure 228 for the aperture 234. By cutting or punching the apertures from the top down, (i.e. from the arms toward the base) the flaps will position to open below the base 224 of the female profile (as shown in FIG. 7) and thereby serve somewhat as a one-way valve to permit powder to flow out of the female profile into the package while preventing powder from flowing from the package into the profile. In place of a single flap, a pair of flaps 230 may be provided hinged from opposite sides of the aperture 234 as depicted in FIG. 6.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper including:

a U-shaped female profile having a base and first and second spaced apart legs extending upwardly from a first side of said base;

a second side of said base opposite to said first side;

an arrow shaped male profile for engaging said female profile, said arrow shaped male profile includes a shaft for inserting into a space between said legs and releasably engaging said first and second legs;

wherein said base of said U-shaped female profile includes at least one aperture passing therethrough providing communication between said space and said second side of said female profile and wherein said female profile legs and base are continuous.

2. The zipper of claim 1 wherein free ends of said U-shaped female profile legs terminate in inwardly pointing detent surfaces so that insertion of said male profile into said space closely positions said shaft between said detent surfaces and tends to urge particles lodged in said space through said aperture to said second side of said female profile.

3. The zipper of claim 2 further including protrusions on said second side of said female profile adjacent to said aperture thereby tending to maintain a gap adjacent to said second side of said female profile when said male profile urges against said female profile.

4. The zipper of claim 1 wherein said aperture is round.

5. The zipper of claim 1 wherein said aperture is oval.

6. The zipper of claim 1 wherein said aperture is elongated.

7. The zipper of claim 1 further including a deflector sheet with a first end and a second end, said first end being secured to said base, and a second end abutting one of said first and second legs.

8. The zipper of claim 1 comprising a plurality of spaced apart apertures in said base.

9. The zipper of claim 1 further comprising a flap for said aperture.

10. The zipper of claim 9 wherein said flap is hinged to said planar base so as to rotate away from said first side.

11. The zipper of claim 1 comprising a pair of flaps hinged to diametrically opposite sides of said aperture on said base second side so as to rotate away from said base first side.

12. A reclosable bag including:

a first panel;

a second panel secured to said first panel on three sides, with an interior of the reclosable bag formed therebetween, and an open end between said first panel and said second panel thereby forming a mouth of the reclosable bag;

a zipper reclosably sealing said mouth, the zipper including; a U-shaped female profile having a base and first and second spaced apart legs extending upwardly from a first side of said base;

a second side of said base opposite to said first side;

an arrow shaped male profile for engaging said female profile, said arrow shaped male profile includes a shaft for inserting into a space between said legs and releasably engaging said first and second legs;

wherein said base of said U-shaped female profile includes at least one aperture passing therethrough providing communication between said space and said second side of said female profile and wherein said female profile legs and base are continuous.

13. The bag of claim 12 wherein an edge of said base of said female profile is secured to said first panel whereby a portion of said base including said aperture is free of attachment to said first panel, thereby providing communication between said space and the interior of the reclosable bag.

14. The bag of claim 13 wherein free ends of said U-shaped female profile legs terminate in inwardly pointing detent surfaces so that insertion of said male profile into said space closely positions said shaft between said detent surfaces and tends to urge particles lodged in said space through said aperture to said second side of said female profile.

15. The bag of claim 13 further including protrusions on said second side of said base thereby tending to maintain a gap between a portion of said second side of said female profile and said first panel when said male profile urges against said female profile.

16. The bag of claim 12 wherein said aperture is round.

17. The bag of claim 12 wherein said aperture is oval.

18. The bag of claim 12 wherein said aperture is elongated.

19. The bag of claim 12 further including a deflector sheet with a first end and a second end, said first end being secured to said base, and said second end abutting one of said first and second legs.

20. The bag of claim 12 comprising a plurality of spaced apart apertures in said planar base.

21. The bag of claim 12 further comprising a flap for said aperture.

22. The bag of claim 21 wherein said flap is hinged to said planar base so as to rotate away from said first side.

23. The bag of claim 12 comprising a pair of flaps hinged to diametrically opposite sides of said aperture on said base second side so as to rotate away from said base first side.

* * * * *